United States Patent [19]

Flammann et al.

[11] Patent Number: 4,615,250

[45] Date of Patent: Oct. 7, 1986

[54] HOUSEHOLD APPLIANCE AND AN ADJUSTABLE GUARD FOR ITS TOOL

[75] Inventors: Norbert Flammann; Edgar Rixen, both of Solingen, Fed. Rep. of Germany

[73] Assignee: Robert Krups Stiftung & Co. KG, Solingen, Fed. Rep. of Germany

[21] Appl. No.: 665,017

[22] Filed: Oct. 26, 1984

[30] Foreign Application Priority Data

Aug. 13, 1984 [DE] Fed. Rep. of Germany ..... 3429724

[51] Int. Cl.[4] ..... B26D 7/22

[52] U.S. Cl. ..... 83/399; 83/478; 83/DIG. 1

[58] Field of Search ..... 83/399, 400, 397, 478, 83/545, 546, 544, DIG. 1

[56] References Cited

U.S. PATENT DOCUMENTS

| | | | |
|---|---|---|---|
| 1,863,328 | 6/1932 | Campbell | 83/546 |
| 1,966,088 | 7/1934 | Campbell | 83/546 |
| 2,065,572 | 12/1936 | Folk | 83/546 X |
| 3,704,736 | 12/1972 | Pratley | 83/860 X |
| 4,070,941 | 1/1978 | Lorenz | 83/397 X |

*Primary Examiner*—James M. Meister
*Attorney, Agent, or Firm*—Peter K. Kontler

[57] ABSTRACT

A household slicing machine wherein a disc shaped rotary knife is mounted in a vertical plane and a guard, which is separable from the housing of the machine, is movable in a second plane that is parallel to the vertical plane of the knife between a first position in which the guard cooperates with an adjustable abutment to conceal the knife, a second position in which the knife is exposed and the machine is ready for use, and a third position in which the guard can be detached from the housing. A spring-biased locking element is reciprocably mounted in the front wall of the housing to extend into an opening of the guard when the latter assumes its second position and to extend in front of an end face of the guard when the latter assumes its first position. This prevents accidental shifting of the guard from the selected position because each such shifting must be preceded by manual depression of the locking element. The guard cooperates with a blocking device which permits depression of a trip in order to start the motor for the knife only in the second position of the guard.

14 Claims, 18 Drawing Figures

FIG. 7
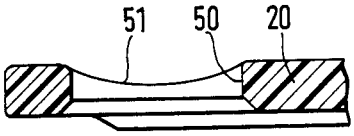
FIG. 8
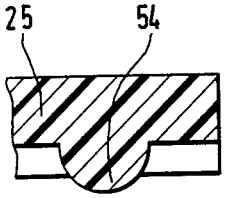
FIG. 9
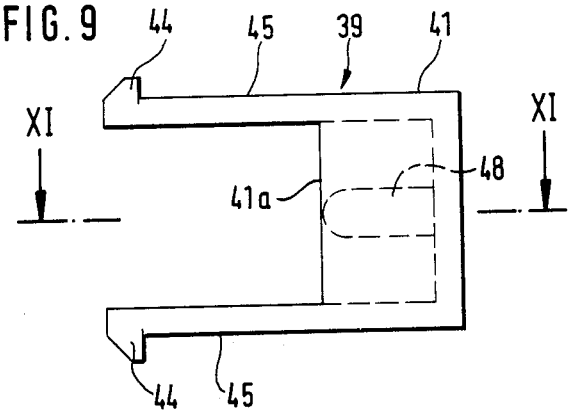
FIG. 10
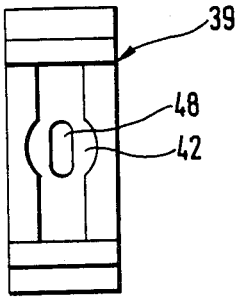
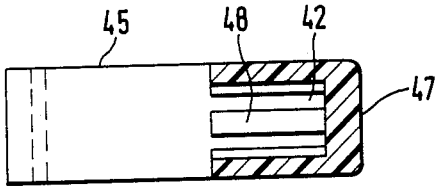
FIG. 11

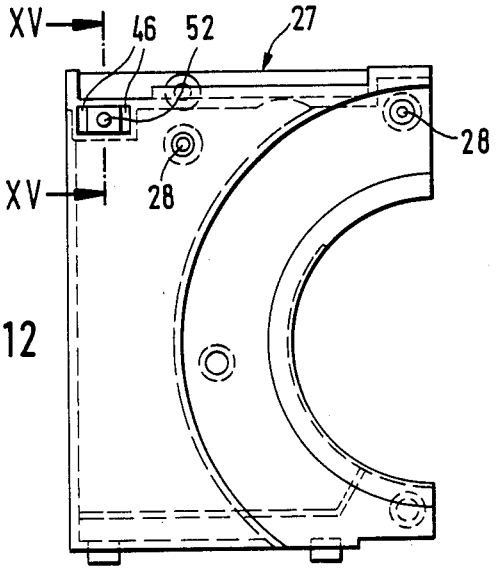
FIG. 12
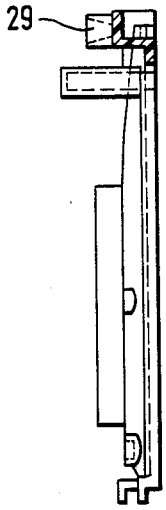
FIG. 13
FIG. 14
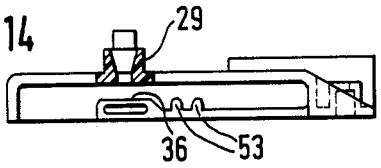
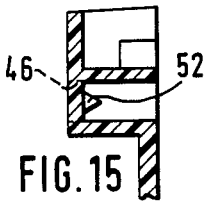
FIG. 15
FIG. 16
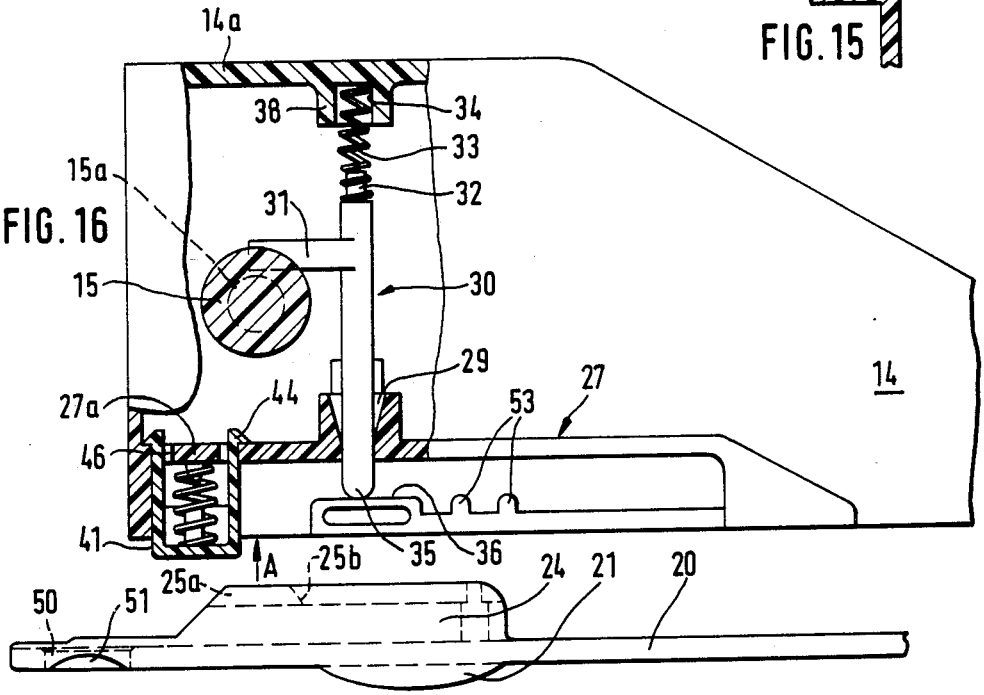

HOUSEHOLD APPLIANCE AND AN ADJUSTABLE GUARD FOR ITS TOOL

CROSS-REFERENCE TO RELATED CASES

The appliance which is disclosed in the present application is or can be substantially identical with the appliance of the commonly owned copending patent application Ser. No. 665,128 filed Oct. 26, 1984 by Norbert FLAMMANN for "Household appliance with an adjustable guard for a rotary tool". Furthermore, the appliance which is disclosed in the present application is similar to the appliance which is described and shown in the commonly owned copending patent application Ser. No. 664,976 filed Oct. 26, 1984 by Norbert Flammann for "Adjustable household slicing machine" and in the commonly owend copending patent application Ser. No. 665,366 filed Oct. 26, 1984 by Stefan Henn et al. for "Adjustable slicing machine for bread and other types of foodstuffs".

BACKGROUND OF THE INVENTION

The present invention relates to appliances in general, and more particularly to improvements in appliances of the type wherein a mobile tool can be shielded by a guard to reduce the likelihood of injury to the operator. Typical examples of such appliances are household slicing machines for bread or other foodstuffs wherein a rotary disc-shaped severing tool is normally installed in a vertical plane and the housing of the machine confines an electric motor which can be started to rotate the tool.

German Utility Model No. 7 611 681 (corresponding to U.S. Pat. No. 4,070,941) discloses a household slicing machine with a protective guard or shroud which is detachable from the housing of the machine and permits the actuating means for the motor switch to start the motor only when the guard is properly attached to the housing. The actuating means comprises a trip for the switch, and such trip is reciprocably mounted in the upper part of the housing of the slicing machine. A barrier is shiftable at a level below the lower end of the trip to oppose the depression of the trip and closing of the motor switch when it extends into the path of downward movement of the trip. A spring is provided to urge the barrier toward the front wall of the housing and into the path of downward movement of the trip. The guard or shroud of the machine which is disclosed in the Utility Model is designed to overlie portions of the rotary disc-shaped slicing knife and has lugs and holding fingers which can be inserted through openings provided therefor in the housing of the slicing machine. One such opening is located in the region of the barrier so that, when the guard is properly affixed to the housing, a selected one of its holding fingers moves the barrier away from the path of downward movement of the trip and the latter can be depressed in order to complete the circuit of the motor which begins to drive the slicing knife. The selected holding finger of the guard then overcomes the bias of the spring which urges the barrier to its blocking position, i.e., into the path of movement of the trip in a direction to close the associated switch and to thus complete the circuit of the motor.

The just described appliance exhibits the advantage that the motor cannot be started as long as the guard is not properly affixed to the housing. The aforementioned spring ensures that the barrier reassumes its blocking position in immediate response to separation of the guard from the housing. However, the just described appliance also exhibits certain drawbacks. For example, the guard cannot completely conceal (i.e., prevent access to) the slicing knife when it is properly affixed to the housing. Thus, the motor for the slicing knife can be started as soon and as long as the guard is properly attached to the housing. This can lead to injuries if the motor is started accidentally when the appliance is not intended to be used. Moreover, it is not possible to shield the slicing knife from contamination when the guard is properly applied but the appliance is not in use for extended periods of time.

The aforementioned copending application Ser. No. 665,128 of Norbert Flammann for "Household appliance with an adjustable guard for a rotary tool" discloses an improved slicing machine wherein the guard is not only separable from the housing but is also shiftable relative thereto in a plane which is preferably parallel to the plane of the slicing knife. Moreover, the appliance of Flammann embodies a blocking device which prevents closing of the starter switch for the motor which drives the slicing knife when the guard is detached, when the guard is barely attached or when the guard prevents access to the knife. This enhances the safety of the appliance because the operator can readily manipulate the guard and/or other parts of the appliance whenever the guard is detached as well as when the guard is attached but is not held in a position in which it exposes a portion of the slicing knife so that the latter can be put to actual use. The appliance of Flammann exhibits the additional advantage that the guard can completely conceal the knife, at least from the front side of the housing, to thus positively prevent injury to a careless or immature manipulator as well as to shield the knife from unnecessary contamination during long periods of non-use while the guard remains attached to the housing. In order to shift the guard from one position to another position, it is merely necessary to engage and push or pull a suitable handgrip which is preferably integral with the guard. This constitutes a convenience because the guard can be shifted to any selected position with the exertion of a relatively small force. However, such ready shiftability of the guard also represents a potential danger, e.g., to a child, if the operator shifts the guard to a position for use of the appliance in which the trip for the motor switch can be readily depressed to start the motor which drives the knife. On the other hand, such mounting of the guard that it can be shifted only in response to the exertion of a pronounced force which would prevent children from changing the position of the guard is also undesirable because this would present problems to a housewife by rendering the manipulation of the guard too cumbersome and strenuous.

OBJECTS AND SUMMARY OF THE INVENTION

An object of the invention is to provide a novel and improved appliance wherein the movable guard can be arrested and locked in at least one position to thus further reduce the likelihood of injury to a careless or immature operator.

Another object of the invention is to provide an appliance, such as a household slicing machine, wherein the guard can be caused to remain in a selected position even if an operator attempts to shift it from such position with the exertion of a pronounced force.

A further object of the invention is to provide the appliance with novel and improved means for reliably but nevertheless releasably locking the guard for the movable tool in one or more selected positions.

Still another object of the invention is to provide an appliance, especially a household slicing machine, which exhibits all advantages of heretofore known appliances but is even less likely to cause injury to a child or another immature person.

An additional object of the invention is to provide the appliance with a very simple but rugged and reliable locking device for the guard and to construct and assemble the locking device in such a way that it can be rapidly detached from the housing of the appliance without necessitating the use of special tools or any tools, which is unobtrusive so that it does not detract from the appearance of the appliance and does not immediately draw the attention of an immature person, and which can be mass-produced and installed at a low cost.

A further object of the invention is to provide a novel and improved method of enhancing the safety of an appliance of the type disclosed in the aforementioned copending application of Flammann.

Another object of the invention is to provide a household slicing machine for bread or the like which embodies the above outlined locking device.

Still another object of the invention is to provide an appliance wherein the guard can be safely locked in that position which it is most likely to assume when the appliance is not in actual use.

The invention is embodied in an appliance, e.g., in a household slicing machine, which comprises a support (e.g., a hollow housing for an electric motor, components of the motor circuit and a transmission), a tool which is movably mounted in or on the support (such tool can constitute a rotary circular slicing knife which is located in a vertical plane), a protective guard or shroud which is mounted on the support and is movable with reference to the tool between a plurality of positions, and means for releasably locking the guard to the support in at least one such position of the guard. For example, the guard can be mounted for movement between a first position (the aforementioned one position) in which it prevents access to the tool and a second position in which at least a portion of the tool is exposed so that the appliance can be put to its intended use, and the locking means is then arranged to prevent (when it assumes the operative position) a movement of the guard from its first position.

In accordance with a presently preferred embodiment of the invention, the locking means comprises a locking element which is movable between the operative and inoperative positions in which the guard is respectively prevented from moving and is free to move relative to the tool. Such locking element can be reciprocably mounted in the support, and the appliance preferably further comprises means (e.g., a coil spring) for biasing the locking element to its operative position. The guard is movable in a predetermined direction and along a predetermined path in order to advance from its one position to another position (it is preferred to mount the guard for movement in a plane which is at least substantially parallel to the preferably vertical plane of the tool) and has a leading face (e.g., a leading edge), as considered in such direction. The locking element is then mounted in such a way that it is disposed in the path of movement of the guard and adjacent to the leading face of the guard in the one position of the guard so that the latter cannot leave the one position unless the locking element is moved out of the way, i.e., unless such element is depressed against the resistance of the biasing means so that it is expelled from the path and the guard is free to leave the one position.

The locking element can constitute a hollow body made of a synthetic plastic or a metallic material and having an open end facing away from the guard. The aforementioned coil spring preferably reacts against the support and bears against the locking element to urge the latter to the operative position. Such coil spring extends through the open end and into the interior of the hollow locking element. The support preferably includes retaining means for preventing the movement of the locking element beyond the operative position, i.e., for preventing separation of the locking element from the support. To this end, the locking element comprises at least one extension and the retaining means includes arresting means which is located in the path of movement of the extension and serves to engage and arrest the extension when the locking element completes its movement from the inoperative to the operative position. The extension is preferably deformable so that it can be disengaged from the arresting means in the deformed condition. For example, the locking element can comprise two rearwardly extending elastic prongs with tooth-shaped pallets which are engageable with arresting means and extend through apertures provided therefor in a preferably detachable front wall of the support. The outer side of such front wall is adjacent to the guard and the inner side of the front wall can constitute the arresting means for the pallets of the elastic prongs. The apertures in the front wall are sufficiently large to permit passage of the pallets when the prongs are elastically deformed if the operator or another person wishes to detach the locking element from the support.

The foremost convolution of the coil spring preferably bears against the inner side of an end wall which forms part of the locking element and is located opposite the open end. Such inner side of the end wall can be provided with a centering stud which is surrounded by at least one convolution of the coil spring. The rearmost convolution of the coil spring preferably reacts against the front side (i.e., against the external surface) of the aforementioned front wall.

The guard is preferably formed with an opening (a portion of such opening is preferably bounded by a frustoconical surface) which receives the front portion of the locking element when the guard is shifted to its second position. The opening is preferably complementary to the front portion of the locking element so that the latter is snugly received and held therein under the action of the coil spring as soon as the guard is shifted to its second position. The front portion of the locking element can be expelled from the opening by a finger when the user of the appliance wishes to shift the guard to the second position or to a further position in which the guard can be detached from the front wall of the housing.

The novel features which are considered as characteristic of the invention are set forth in particular in the appended claims. The improved appliance itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 7 is an enlarged fragmentary sectional view as seen in the direction of arrows from the line VII—VII of FIG. 4;

FIG. 8 is an enlarged fragmentary sectional view as seen in the direction of arrows from the line VIII—VIII of FIG. 6;

FIG. 9 is an enlarged side elevational view of the locking element;

FIG. 10 is an end elevational view as seen from the right-hand side of FIG. 9;

FIG. 11 is a sectional view as seen in the direction of arrows from the line XI—XI of FIG. 9;

FIG. 12 is an enlarged front elevational view of a detachable front wall of the housing which constitutes the support of the improved appliance;

FIG. 13 is a side elevational view of the front wall;

FIG. 14 is a plan view of the front wall;

FIG. 15 is an enlarged fragmentary sectional view as seen in the direction of arrows from the line XV—XV of FIG. 12;

FIG. 16 is a fragmentary plan view of the appliance, with the guard detached from the front wall of the housing and with the locking element in the operative position;

DESCRIPTION OF THE PREFERRED EMBODIMENTS

Figure 1:
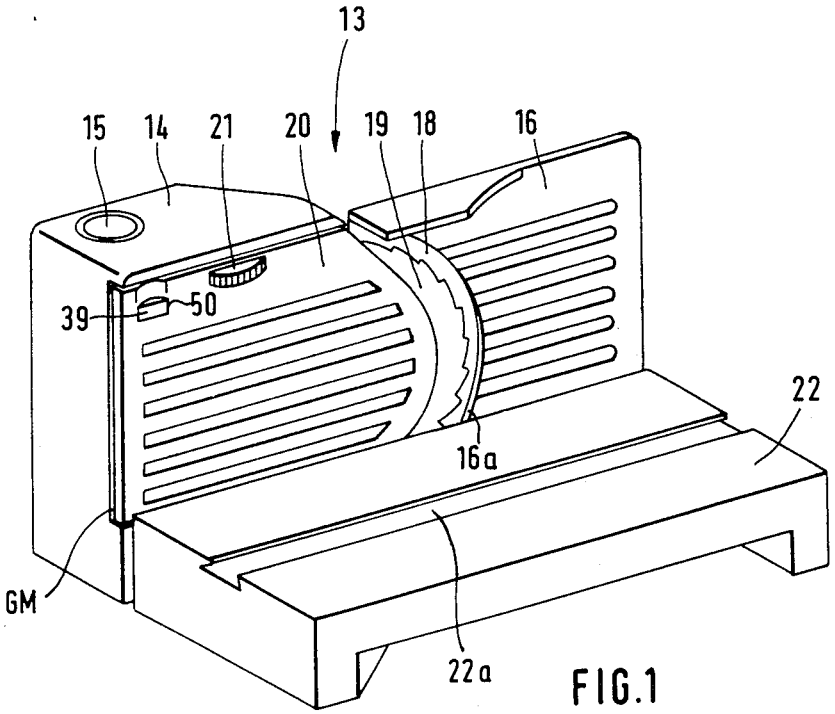
FIG. 1 is a schematic perspective view of the front side of an appliance which constitutes a household slicing machine and embodies the present invention, the guard being shown in its second position in which a portion of the rotary severing tool of the appliance is accessible for the slicing of bread or the like and the locking element being held in the inoperative position.
Figure 2:
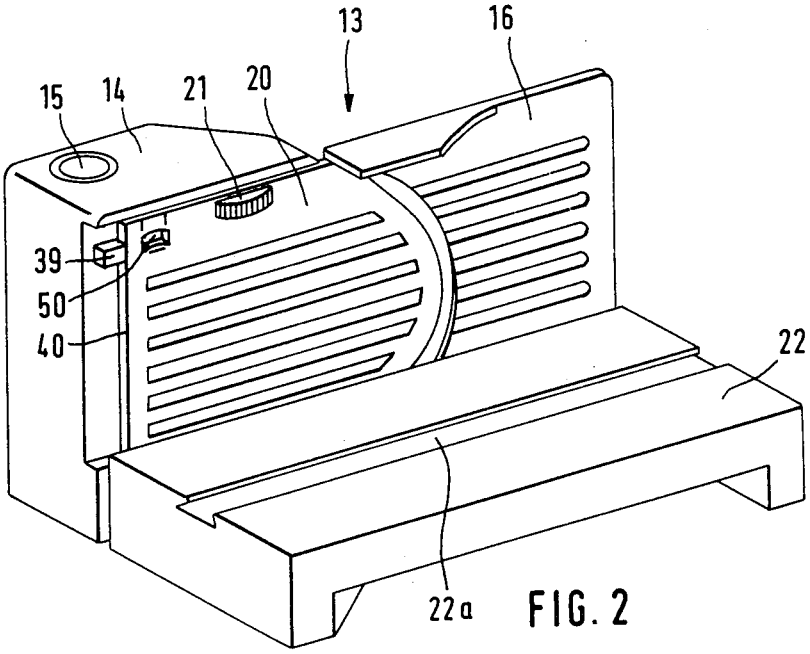
FIG. 2 is a similar perspective view but showing the guard in its first position in which the guard cooperates with an adjustable abutment to prevent access to the tool, the locking element being shown in the operative position.
Figure 3:
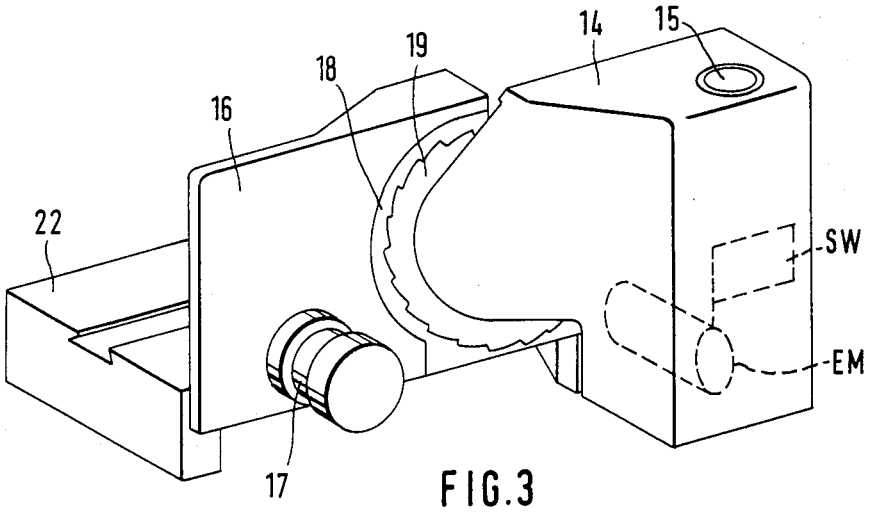
FIG. 3 is a schematic perspective view of the rear side of the appliance, showing the adjusting means for the abutment.

Referring first to FIGS. 1 to 3, there is shown an appliance 13 which constitutes a slicing machine for bread or other types of foodstuffs. The appliance 13 comprises a housing or support 14 which confines an electric motor EM (indicated in FIG. 3 by broken lines) and a switch SW which is in circuit with the motor and must be closed to thus complete the motor circuit and set in rotation a rotary tool 19 in the form of a disc-shaped knife having a toothed cutting edge. The transmission between the output shaft of the motor EM and the shaft of the tool 19 is not specifically shown in the drawing. The appliance 13 can be provided with means for varying the speed of the tool 19, e.g., by utilizing a variable speed transmission. The means for actuating the switch SW so as to complete the circuit of the motor EM includes an elongated trip 15 which is reciprocably installed in the housing 14 and must be depressed by hand in order to close the switch SW. In the illustrated embodiment, the upper end portion of the trip 15 is accessible by way of an opening in the top wall of the housing 14.

The appliance 13 further comprises an upright plate-like abutment 16 which is adjustably secured to a bridge-like working platform 22 of the appliance. The platform 22 is located in front of the housing 14 and carries an adjusting device 17 (see FIG. 3) which serves to move the plane of the abutment 16 nearer to or further away from the vertical plane of the tool 19 and to thus reduce or increase the thickness of slices which can be severed from a loaf of bread or from a sausage or salami which is placed onto the platform 22 so that it bears against the front side (shown in FIGS. 1 and 2) of the abutment 16 and is thereupon moved in a direction to the left, as viewed in FIG. 1 or 2. The slice which is severed from the loaf passes through an arcuate sickle-shaped slot 18 between the cutting edge of the tool 19 and the adjacent concave edge face 16*a* of the abutment 16 and the slice emerges from such slot at the rear side of the housing 14, i.e., at the side which is shown in FIG. 3.

The manner in which the tool 19 can be separated from the output element of the transmission which receives torque from the motor EM (so that the tool can be inspected, cleaned or replaced) is not specifically shown in the drawing.

In the illustrated appliance 13, the tool 19 is mounted in a vertical plane which is parallel to the plane of the abutment 16 as well as to the general plane of a protective shroud or guard 20 which is separably and movably secured to a detachable front wall 27 (see FIGS. 12 to 15) of the housing 14. FIG. 2 shows the guard 20 in a first position in which it cooperates with the abutment 16 to fully prevent access to the tool 19 from the front side of the housing 14, FIG. 1 shows the guard 20 in a second position in which the tool 19 is exposed sufficiently to allow for its use as a means for severing bread or another foodstuff, and FIG. 16 shows the guard 20 in a detached position adjacent to a third position in which latter position the guard also permits access to the tool 19 but the motor EM for the tool 19 cannot be started, the same as in the first position (FIG. 2) of the guard.

Figure 4:
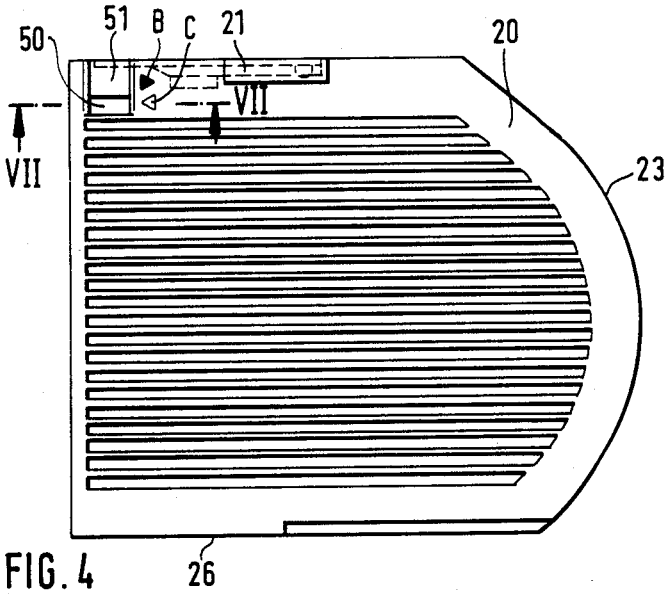
FIG. 4 is an enlarged front elevational view of the guard.
Figure 5:
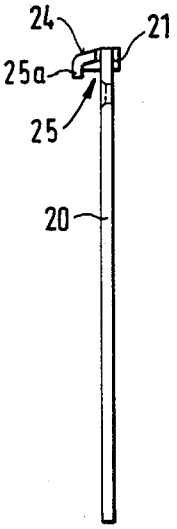
FIG. 5 is an end elevational view of the guard as seen from the left-hand side of FIG. 4.
Figure 6:
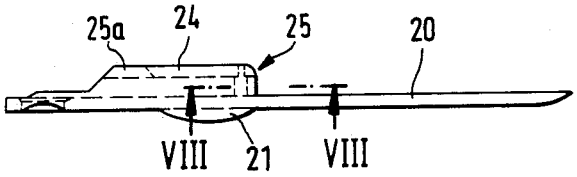
FIG. 6 is a plan view of the guard which is shown in FIG. 4.

As shown in FIGS. 4, 5 and 6, the illustrated guard 20 is a one-piece member which is preferably made of a suitable synthetic plastic material. Such one-piece member is bounded by straight edge faces at three of its sides and by a convex edge face 23 at the fourth side. When the guard 20 is moved to the first position of FIG. 18, such convex edge face 23 is sufficiently close to (or can actually contact the adjacent concave edge face 16*a* of the abutment 16 to prevent access to the tool 19 from the front side of the appliance 13. The radii of curvature of the edge faces 16*a* and 23 can equal or approximate the radius of the tool 19.

The straight lower marginal portion 26 of the guard 20 is receivable in a complementary channel or other suitable guide means GM of the housing 14 to ensure that the plate-like member which constitutes the guard 20 is reciprocable in a vertical plane which is parallel to the plane of the tool 19. The guide means GM is preferably disposed between the detachable front wall 27 of the housing 14 and the adjacent portion of the working platform 22. The latter is rigid with and can be said to constitute a component part of the housing 14. The reference character 22*a* denotes in FIGS. 1 and 2 a dovetailed groove which is provided in the upper side of the platform 22 and can receive a reciprocable carriage for the foodstuff to be sliced or for the remnant of such foodstuff.

The surfaces surrounding the guide means GM of the housing 14 and the lower marginal portion 26 of the guard 20 can be said to constitute a means for releasably coupling the guard 20 to the housing 14 in such a way that the guard is movable in a plane which is parallel to the vertical plane of the tool 19.

The guard 20 further comprises a cam face 24 which is provided on an elongated cam 25 having in part a substantially L-shaped cross sectional outline (see FIG. 5). The cam 25 extends from one side of the upper marginal portion of the guard 20. When the guard 20 is properly mounted in the housing 14, the cam 25 faces toward the inner side of the rear wall 14*a* of the housing 14. The other or outer side of the guard 20 is provided with a handgrip means 21 in the form of a substantially semicircular knurled projection which can be manipulated by hand in order to move the guard in its vertical plane between the aforementioned first, second and third positions. The second position (shown in FIG. 17) is disposed between the first and third positions, i.e., the handgrip means 21 must be actuated to shift the guard 20 in a first direction (to the right, as viewed in FIG. 17) in order to move the guard to the first position of FIG. 18 and in a second direction (to the left, as viewed in FIG. 17) counter to the first direction in order to move the guard to the third position (namely to a position at a level slightly above that shown in FIG. 16).

The details of the front wall 27 of the housing 14 are shown in FIGS. 12 to 15. When properly attached to the remaining major part of the housing 14, this front wall is adjacent to the inner side of the guard 20 when the latter assumes the first position of FIG. 18 or the second position of FIG. 17 (as well as the third position in which the guard can be readily separated from the housing 14). The means for separably securing the front wall 27 to the major part of the housing 14 includes screws (not specifically shown) or other types of fasteners which extend through suitably distributed holes or bores 28 in the wall 27. The inner side 27*a* of the front wall 27 (i.e., that side which faces the interior of the housing 14 and the motor EM therein) is formed with an annular bearing 29 having a tapering axial passage for the rounded front end portion or follower 35 of an elongated bolt 30 forming part of means for blocking the movement of the trip 15 to the operative position (in order to close the switch SW for the motor EM) when the guard 20 is detached from the housing 14, when the guard assumes its third position or when the guard assumes its first position. The rear end portion 32 of the bolt 30 has a reduced diameter and extends into the foremost convolutions of a displacing means here shown as a helical tension spring 33 which reacts against the rear wall 14*a* of the housing 14 and urges the bolt 30 forwardly, i.e., toward the inner side of the guard 20. The rearmost convolutions of the spring 33 extend into a blind bore or hole 34 of an annular socket 38 which extends forwardly from the inner side of the rear wall 14*a* of the housing 14. The foremost convolution of the spring 33 bears against an annular shoulder which is located between the smaller-diameter rear end portion 32 and the larger-diameter major portion of the bolt 30.

The means for blocking the movement of the trip 15 to its operative position in certain positions of the guard 20 further comprises a projection 31 in the form of a straight arm which is integral with or separably affixed to and extends at right angles to a central portion of the bolt 30. The arm 31 can enter a circumferential groove 15*a* in the peripheral surface of the reciprocable trip 15 and, when it is free to enter such groove under the action of the spring 33, the trip 15 is held against depression, i.e., against movement from the inoperative position to the operative position in which the lower end portion of the trip closes the switch SW to thereby complete the circuit of the motor EM and set the tool 19 in rotary motion at a speed which is selected by the ratio of the transmission. The length of the arm 31 can be a small fraction of the length of the bolt 30.

FIG. 16 shows that the front wall 27 is already secured to the major part of the housing 14. This front wall has a stop 36 which is located in front of the bearing 29 and is engaged by the front end portion or follower 35 of the bolt 30 when the spring 33 is free to expand. In FIG. 16, the spring 33 is free to expand because the guard 20 is still detached from the housing 14. The arm 31 on the bolt 30 extends into the circumferential groove 15*a* of the trip 15 so that the motor EM cannot be started.

Figure 17:
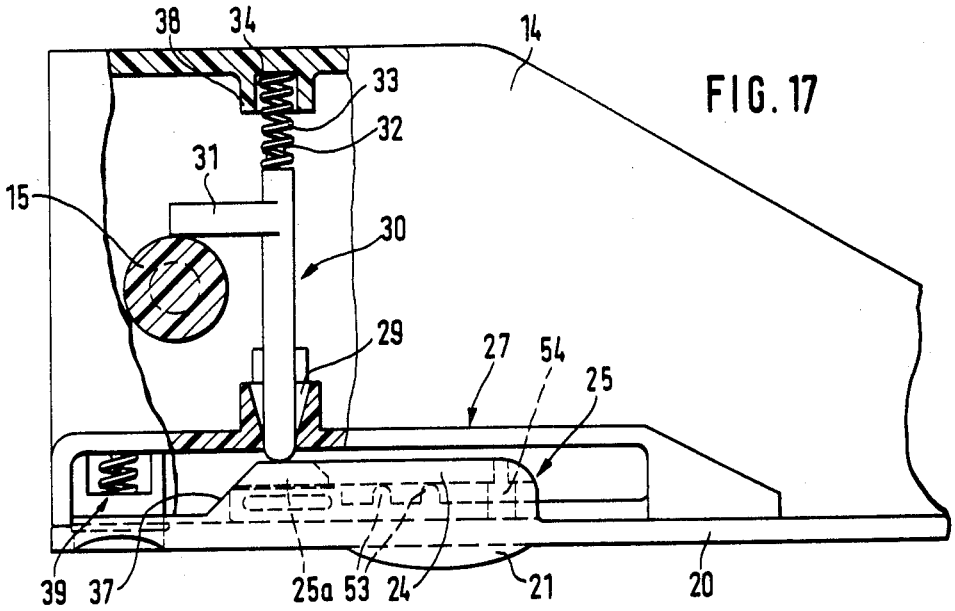
FIG. 17 illustrates the structure of FIG. 16 but with the guard shown in the second position in which a cam on the guard maintains the blocking means out of engagement with the stop means of the front wall so that the actuating means is free to leave its inoperative position, the locking element for the guard being shown in the inoperative position.
Figure 18:
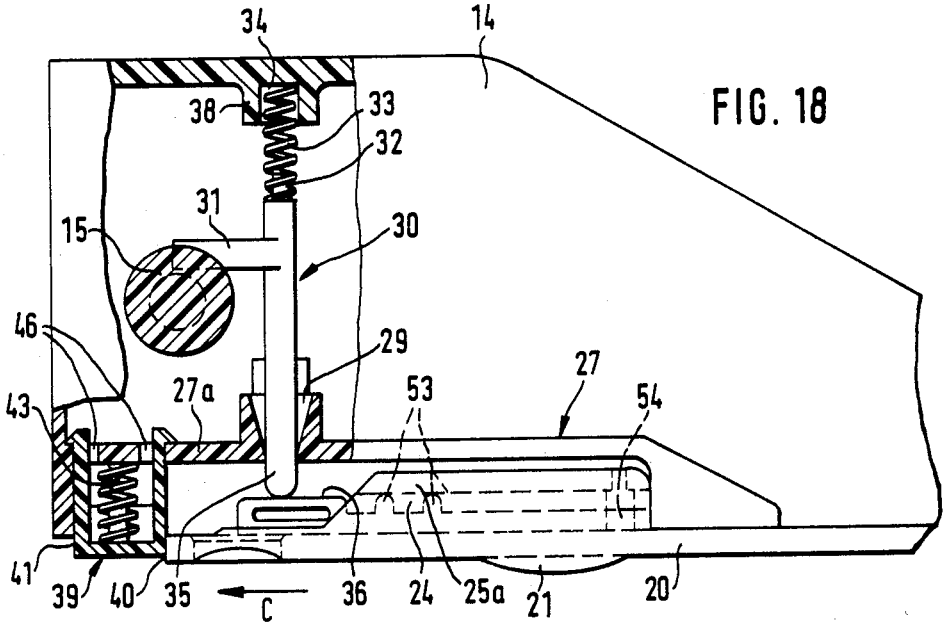
FIG. 18 is a view similar to that of FIG. 17 but showing the guard in the first position in which the guard is held by the locking element so that it cannot be shifted to the position of FIG. 17.

If the guard 20 is thereupon moved upwardly (arrow A), as viewed in FIG. 10, so that its lower marginal portion 26 can enter the aforementioned guide means GM between the front wall 27 and the working platform 22, the cam 25 moves rearwardly and beyond the stop 36 of the front wall 27 but the follower 35 of the bolt 30 is not immediately depressed against the opposition of the spring 33, i.e., the bolt 30 is not immediately caused to assume the position which is shown in FIG. 17. For this, the entire bolt 30 must be moved nearer to the rear wall 14*a* of the housing 14 and the arm 31 must be expelled from the circumferential groove 15*a* of the trip 15 so that the operator of the appliance 13 can depress the trip 15 in order to start the motor EM via switch SW. As can be seen in FIGS. 16 to 18, the cam 25 comprises a relatively short downwardly extending portion 25*a* which is not in register with the follower 35 of the bolt 30 when the guard 20 is moved to its third position (to the left of the second position shown in FIG. 17). Thus, and referring again to FIG. 16, if the guard 20 is simply moved upwardly (as indicated by the arrow A), the cam portion 25*a* is located to the left of the follower 35 so that the latter continues to abut against the stop 36 of the front wall 27 and the arm 31 continues to block the movement of the trip 15 from its inoperative position. In other words, the cam 25 is not effective in the third position of the guard 20 because the follower 35 of the bolt 30 then continues to bear against the stop 36 under the action of the spring 33.

In order to expel the arm 31 from the groove 15*a*, it is necessary to shift the guard 20 (preferably by pushing or pulling the handgrip means 21) in a direction to the right, as viewed in FIG. 16, so that a sloping edge face 25*b* of the cam portion 25*a* moves the follower 35 away from the stop 36 and the follower 35 then bears against the adjacent side of the cam portion 25*a* with the result that the arm 31 is held out of the groove 15*a*. The convex edge face 23 of the guard 20 is then still remote from the concave edge face 16*a* of the abutment 16 so that the appliance 13 is ready for use, i.e., the parts 16 and 20 expose a sufficiently large portion of the tool 19 to allow for the slicing of bread or the like as soon as the trip 15 is depressed in order to close the switch SW and to thereby start the motor EM.

If the operator wishes to prevent depression of the trip 15 from its inoperative position while the guard 20 remains properly attached to the housing 14, the handgrip means 21 is engaged to shift the guard from the second position of FIG. 17 to the first position of FIG. 18 by moving the guard in a direction to the right, as viewed in FIG. 17. The follower 35 then tracks a sloping portion 37 of the face 24 of the cam 25 under the bias of the spring 33 and returns into engagement with the stop 36 of the front wall 27 (see FIG. 12). The arm 31 is returned into the groove 15*a* of the trip 15 and the convex edge face 23 of the guard 20 is closely or immediately adjacent to the concave edge face 16*a* of the abutment 16 so that the parts 16 and 20 cooperate to prevent access to the tool 19 from the front side (FIGS. 1 and 2) of the appliance 13. Thus, the blocking means including the bolt 30 and its arm 31 is effective not only in the third position of the guard 20, when the latter is ready to be detached from the housing 14, but also in the first position in which the guard prevents access to the tool 19.

If the operator wishes to use the appliance 13, the handgrip means 21 is engaged to move the guard 20 from the first position of FIG. 18 to the second position of FIG. 17 whereby the inclined portion 37 of the cam face 24 lifts the follower 35 off the stop 36 and guides it against the rear side of the cam portion 25*a* which entails automatic expulsion of the arm 31 from the groove 15*a*.

Should the operator desire to detach the guard 20 from the housing 14, the handgrip means 21 is shifted in a direction to the left, as viewed in FIG. 17, so that the portion 25*a* of the cam 25 moves beyond the follower 35 and the latter is again free to return into contact with the stop 36 under the action of the spring 33. Thus, the trip 15 is blocked in the inoperative position not later than when the guard 20 reaches the (third) position in which it can be detached from the front wall 27 of the housing 14. Detachment of the guard 20 from the front wall 27 entails at least substantial exposure of the tool 19, i.e., the latter is then accessible for the purpose of inspection, cleaning or replacement.

As can be seen in FIGS. 1, 2, 4, 6 and 7, the upper left-hand corner portion of the guard 20 (as seen from the front side of the assembled appliance 13) is formed with an opening or window 50 which can receive the outer or front portion of a locking device 39 when the guard 20 is held in the second position (shown in FIGS. 1 and 17). The locking device 39 constitutes a safety feature which reduces the likelihood of accidental shifting of the guard 20 between its three positions relative to the housing 14. The configuration of at least a portion of the opening 50 is preferably such that the outer portion of the locking device 39 can be received therein snugly, i.e., practically without play. In order to facilitate convenient depression of the locking device 39 preparatory to shifting of the guard 20 from the position of FIG. 1, the front or outer portion of the opening 50 is bounded by a substantially frustoconical surface 51 (this can be more readily seen in FIG. 7).

The illustrated locking device 39 comprises a one-piece locking element 41 (see particularly FIGS. 9, 10 and 11) which can be made of a suitable synthetic plastic material and is a hollow body having a substantially rectangular cross-sectional outline, a closed outer or front end constituted by an end wall 47, an open rear or inner end 41*a* opposite the end wall 47, and two elongated extensions in the form of elastic prongs 45 which extend rearwardly beyond the open end 41*a*. The free ends of the extensions 45 are provided with outwardly extending pallets 44 in the form of teeth. The means for biasing the element 41 forwardly, i.e., in a direction away from the rear wall 14*a* of the housing 14, comprises a coil spring 43 (FIGS. 16, 17 and 18) which reacts against the front side of the front wall 27 of the housing 14 and bears against the inner side of the end wall 47, i.e., the coil spring 43 extends into the internal compartment 42 of the hollow element 41. When the coil spring 43 is free to expand and to maintain the element 41 in the operative position which is shown in FIGS. 2, 16 and 18, the pallets 44 at the free rear ends of the extensions 45 bear against the inner side or surface 27*a* of the front wall 27, and such inner side can be said to constitute a means for arresting the element 41 in the operative position, i.e., the inner side 27*a* prevents the element 41 from moving forwardly beyond the operative position of FIGS. 2, 16 or 18. The extensions 45 extend through two slot-shaped apertures 46 which are provided in the front wall 27 of the housing 14 and are large enough to permit the pallets 44 to pass therethrough when the extensions 45 are deformed so as to move the pallets nearer to each other. The inner side of the front end wall 47 of the element 41 is formed with a centering stud 48 which is surrounded by one or more foremost convolutions of the coil spring 43. As shown in FIGS. 9 to 11, the extensions 45 project beyond the two narrower sidewalls of the element 41 so that they can be more readily flexed when the element 41 is to be installed in or detached from the front wall 27. The outer sides of the extensions 45 guide the element 41 for reciprocatory movement relative to the front wall 27 under the action or against the opposition of the coil spring 43. FIGS. 12 and 15 show a second centering stud 52 which is provided at the front side of the wall 27 between the apertures 46 and is surrounded by one or more rearmost convolutions of the coil spring 43.

The inner side of the front wall 27 is provided with reinforcing ribs 53 (see FIGS. 14 and 16 to 18), and the guard 20 is formed with a reinforced or enlarged portion 54 which can be seen in FIG. 8.

The mode of operating the locking device 39 is as follows:

When the guard 20 assumes the (second) position which is shown in FIGS. 1 and 17, the front portion (including the end wall 47) of the hollow locking element 41 extends into the opening 50 of the guard and is held in such opening under the action of the coil spring 43 which reacts against the front side or surface of the front wall 27. The element 41 then releasably holds the guard 20 in that position in which the tool 19 is accessible so that the appliance 13 can be used for the slicing of bread or the like. The extent of penetration of the front portion of the element 41 into the opening 50 suffices to ensure that the guard 20 cannot leave the position of FIGS. 1 or 17 until and unless the end wall 47 is manually expelled from the opening 50 against the opposition of the coil spring 43. The directions in which the guard 20 is movable from the position which is shown in FIGS. 1 and 17 are indicated by arrows B and C which are shown in the upper left-hand portion of FIG. 4.

If the operator wishes to move the guard 20 from the position of FIG. 1 to the position of FIG. 2 (arrow B), it is necessary to manually depress the front end wall 47 so as to expel the element 41 from the opening 50 against the resistance of the coil spring 43. The movement of the guard 20 in the direction of arrow B is terminated when the guard reaches the (first) position of FIG. 18 in which its convex edge face 23 either contacts or is very close to the concave edge face 16*a* of the abutment 16 to prevent access to the tool 19 from the front side of the appliance 13. The front edge face 40 of the guard 20 is then located to the right of the locking element 41 so that the coil spring 43 is free to expand and move the element 41 to the operative position which is shown in FIGS. 2 and 18 and in which the element 41 positively prevents the guard 20 from leaving its first position, i.e., from moving in the direction which is indicated by the arrow C. The coil spring 43 then maintains the pallets 44 on the extensions 45 of the locking element 41 in engagement with the arresting means (inner side or surface 27*a* of the front wall 27). It will be noted that the guard 20 is automatically locked in the position which is shown in FIGS. 2 and 18 so that the motor EM cannot be started and the tool 19 remains concealed at the front side of the appliance 13.

The spring 43 automatically holds the element 41 in the operative position when the guard 20 is detached from the front wall 27 (subsequent to movement to its third position). This can be seen in FIG. 16. If the guard 20 is to be reattached to the housing 14, it depresses the locking element 41 against the resistance of the coil spring 43 and, when the guard 20 is thereupon shifted in the direction of arrow B to assume the position which is shown in FIGS. 1 and 17, the front portion of the element 41 automatically snaps into the opening 50 to thus ensure that the guard is releasably held in the second position and can leave such position only in response to manual depression of the end wall 47. Depression of the bolt 30 by the portion 25*a* of the cam 25 on the guard 20 can take place ahead of penetration of the front portion of the element 41 into the opening 50. At any rate, the arm 31 permits depression of the trip 15 and the element 41 locks the guard 20 not later than when the guard reaches the position of FIG. 17.

An important advantage of the improved appliance is that it is safer than the heretofore known appliances. Thus, the element 41 can prevent unintentional shifting of the guard 20 from the position of FIG. 18, and the element 41 also holds the guard 20 in the position of FIG. 17 until and unless the operator decides to depress the element 41 against the opposition of the spring 43 in order to release the guard for movement in the direction of arrow C (from the position of FIG. 18) or in the direction of arrow B or C (from the position of FIG. 17). When it is locked in the position of FIG. 18, the guard 20 cooperates with the blocking means including the bolt 30 and the arm 31 to prevent depression of the trip 15, and the guard 20 cooperates with the abutment 16 to prevent access to the tool 19 from the front side of the appliance 13. When it is locked in the position of FIG. 17, the guard 20 ensures that the width of the sickle-shaped slot 18 remains unchanged and that the appliance 13 is ready for use as soon as the operator decides to depress the trip 15 in order to complete the circuit of the motor EM. The need for depression of the locking element 41 in response to attachment of the guard 20 to the front wall 27 of the housing 14 is also desirable and advantageous because this ensures that the coil spring 43 stores energy which is needed to reliably hold the front portion of the element 41 in the opening 50 as soon as the guard 20 reaches the position of FIG. 17.

The aforedescribed configuration of the element 41 (as a hollow body with an open rear end 41*a* and two prong-like elastically deformable extensions 45 for pallets 44 which normally prevent detachment of the element 41 from the front wall 27) is desirable and advantageous because the compartment 42 of the element 41 provides room for a large portion of the coil spring 43 and not only shields and confines this spring but also guarantees that the direction of the force which the spring applies to the element 41 is always such as to urge the element 41 from the inoperative position to the operative position of FIG. 18. That position of the element 41 which is shown in FIG. 17 can be termed an intermediate position because the element 41 is not fully depressed but the pallets 45 are not in contact with the rear side or face 27*a* of the front wall 27. It is clear that the pallets 45 and the extensions 44 are optional since the element 41 or an analogous locking element can be movably secured to the front wall 27 in many other ways. The illustrated construction of the element 41 is preferred at this time because the element can be attached to or detached from the front wall 27 with little loss in time. The elasticity of the extensions 45 should suffice to ensure that they invariably tend to maintain the pallets 44 in the positions which are shown in FIGS. 16 to 18, i.e., that the pallets strike against the rear side 27*a* of the front wall 27 when the coil spring 43 is free to expand in order to prevent a movement of the element 41 beyond the operative position of FIG. 18.

The configuration of the front or outer portion of the opening 50 (namely of the portion which is bounded by the aforementioned frustoconical or a similar surface 51) is such that a finger can readily depress the front portion of the element 41 rearwardly and beyond the inner side of the guard 20 so that the latter is free to move in the direction of arrow B or C (depending upon whether the operator wishes to shift the guard to the position of FIG. 18 or to the third position in which the guard can be detached from the front wall 27).

The bias of the coil spring 43 can be selected practically at will. A pronounced bias of such spring will ensure that a child is even less likely to be able to depress the element 41 from the operative position of FIG. 2 or from the intermediate position of FIGS. 1 or 17. All that actually counts is to ensure that the bias of the coil spring 43 suffices to ensure that the front portion of the element 41 will penetrate into the opening 50 as soon as the guard 20 reaches the position of FIG. 17 and that the element 41 will be compelled to assume its operative position as soon as the guard 20 is moved to the position which is shown in FIG. 18. The spring 43 does not offer any appreciable resistance to movement of the guard 20 from the detached position of FIG. 16 to the third position.

The improved appliance is susceptible of many additional modifications without departing from the spirit of the invention. As already mentioned above, the element 41 can be modified in a number of ways, depending upon whether or not the manufacturer wishes to establish a separable connection between the locking means and the housing of the appliance. It is also possible to mount the mobile locking element on the guard 20 and to cause such element to enter suitably distributed openings in the front wall 27 when the guard 20 assumes the position of FIGS. 17 and 18. It is also possible to provide two or more locking elements in order to even further enhance the safety of the appliance.

The improved locking means can be used in a wide variety of machines, such as household appliances. The illustrated slicing machine is but one of numerous appliances in which the improved locking means can be put to use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An appliance, such as a household slicing machine, comprising a support; a tool movably mounted in said support; a protective guard mounted in said support and, while mounted on said support, being movable between a plurality of positions with reference to said tool; and means for positively but releasably locking said guard to said support in at least one of said positions, said locking means including a hollow locking element having an open end facing away from said guard and being movable between operative and inoperative positions in which said guard is respectively prevented from moving and is free to move relative to said tool, said locking means further comprising resilient means reacting against said support and bearing against said element to urge the latter to said operative position, said resilient means extending through said open end and into the interior of said element.

2. The appliance of claim 1, wherein said guard is movable between a first position in which it prevents access to said tool and a second position in which at least a portion of said tool is exposed, said locking element being arranged to prevent, in said operative position thereof, a movement of said guard from said first position.

3. The appliance of claim 1, wherein said locking element is reciprocably mounted in said support and further comprising means for biasing said locking element to said operative position.

4. The appliance of claim 3, wherein said guard is movable in a predetermined direction and along a predetermined path from said one position to another position thereof and has a leading face, as considered in said direction, said locking element being disposed in said path and being adjacent to said leading face in the one position of said guard and in the operative position of said locking element.

5. The appliance of claim 1, wherein said element has an end wall opposite said open end and said resilient means bears against said end wall.

6. The appliance of claim 5, wherein said end wall has a stud in the interior of said element and said resilient means includes a coil spring having a plurality of convolutions at least one of which surrounds said stud.

7. The appliance of claim 6, wherein said support includes a front wall which is adjacent to said guard and said element is movably mounted on said front wall, said front wall having an external surface and said coil spring reacting against said external surface.

8. The appliance of claim 1, wherein said guard is movable between a first position in which it prevents access to said tool and a second position in which at least a portion of said tool is exposed, said locking element being arranged to prevent, in said operative position thereof, a movement of said guard from said first position, said guard having an opening and said resilient means being arranged to urge a portion of said element into said opening in the second position of said guard.

9. The appliance of claim 8, wherein said opening is at least substantially complementary to said portion of said element so that the latter is snugly received in said opening under the action of said resilient means in the second position of said guard.

10. The appliance of claim 8, wherein said guard has a frustoconical surface bounding a portion of said opening.

11. An appliance, such as a household slicing machine, comprising a support; a tool movably mounted in said support; a protective guard mounted in said support and movable between a plurality of positions with reference to said tool; and means for releasably locking said guard to said support in at least one of said positions, including a hollow locking element having an open end facing away from said guard and movable between operative and inoperative positions in which said guard is respectively prevented from moving and is free to move relative to said tool, and resilient means reacting against said support and bearing against said element to urge the latter to said operative position, said resilient means extending through said open end and into the interior of said element, said support including retaining means for preventing the movement of said element beyond said operative position and said element comprising at least one extension, said retaining means including arresting means located in the path of movement of said extension and arranged to engage and arrest said extension when said element completes its movement from said inoperative to said operative position.

12. The appliance of claim 11, wherein said extension is deformable and is disengageable from said arresting means in the deformed condition thereof.

13. The appliance of claim 12, wherein said element comprises two elastic extensions which project beyond said open end and have pallets engageable with said arresting means.

14. The appliance of claim 13, wherein said support includes a housing having a wall which is adjacent to said guard, said wall having openings for said extensions, an external surface facing said guard and an internal surface constituting said arresting means.

* * * * *